US010513829B2

(12) United States Patent
Jones

(10) Patent No.: US 10,513,829 B2
(45) Date of Patent: Dec. 24, 2019

(54) EDGE STABILIZATION ASSEMBLY FOR GOLF COURSES, SHORELINES AND PLAYGROUNDS

(71) Applicant: Casey Thomas Jones, Sugarland, TX (US)

(72) Inventor: Casey Thomas Jones, Sugarland, TX (US)

( * ) Notice: Subject to any disclaimer, the term of this patent is extended or adjusted under 35 U.S.C. 154(b) by 0 days.

(21) Appl. No.: 16/422,476

(22) Filed: May 24, 2019

(65) Prior Publication Data

US 2019/0360161 A1 Nov. 28, 2019

Related U.S. Application Data

(60) Provisional application No. 62/676,337, filed on May 25, 2018.

(51) Int. Cl.

| | |
|---|---|
| ***A63B 57/50*** | (2015.01) |
| ***E02D 17/04*** | (2006.01) |
| ***E01C 13/08*** | (2006.01) |
| ***E02B 3/12*** | (2006.01) |
| ***E02D 17/20*** | (2006.01) |

(52) U.S. Cl.

CPC ..... *E01C 13/08* (2013.01); *E02B 3/126* (2013.01); *E02D 17/202* (2013.01); *E02D 2200/13* (2013.01); *E02D 2300/001* (2013.01); *E02D 2300/0006* (2013.01); *E02D 2300/0007* (2013.01); *E02D 2300/0009* (2013.01); *E02D 2300/0014* (2013.01)

(58) Field of Classification Search

CPC ..... E02D 17/04; E02D 17/202; A63B 57/50

USPC ..... 405/302.4, 302.6, 302.7; 473/173

See application file for complete search history.

(56) References Cited

U.S. PATENT DOCUMENTS

| | | | | |
|---|---|---|---|---|
| 3,433,137 | A * | 3/1969 | Henderson | E01C 13/08 472/92 |
| 8,845,443 | B1 * | 9/2014 | Weaver | E01C 13/065 405/302.6 |
| 2006/0193703 | A1 * | 8/2006 | Carlson | E02D 17/205 405/302.4 |
| 2009/0038214 | A1 * | 2/2009 | Rozen | A01G 9/28 47/33 |
| 2013/0116060 | A1 * | 5/2013 | Allen | A63B 69/3661 473/173 |
| 2014/0170339 | A1 * | 6/2014 | Ayers | E02D 17/20 428/17 |
| 2017/0002533 | A1 * | 1/2017 | Laurence | B29B 7/002 |
| 2017/0191230 | A1 * | 7/2017 | Doble | E01C 13/06 |
| 2017/0225051 | A1 * | 8/2017 | Lemons | E02D 17/20 |
| 2018/0021654 | A1 * | 1/2018 | Doble | E01C 13/02 473/173 |

FOREIGN PATENT DOCUMENTS

KR 20100082645 A * 7/2010

* cited by examiner

*Primary Examiner* — Sunil Singh
(74) *Attorney, Agent, or Firm* — Nolte Intellectual Property Law Group

(57) ABSTRACT

An edge stabilization assembly for inclined surfaces having a synthetic tuft assembly; a water-permeable polymer mesh connected on one side of the synthetic tuft assembly, and a tuft-free non-permeable woven polymer mat connected on the other side of the synthetic tuft assembly, and a plurality of fasteners.

23 Claims, 7 Drawing Sheets

EDGE STABILIZATION ASSEMBLY FOR GOLF COURSES, SHORELINES AND PLAYGROUNDS

CROSS REFERENCE

This application claims the benefit of U.S. Provisional Application No. 62/676,337, filed May 25, 2018, the contents of which are incorporated herein by reference in its entirety to the extend consistent with the present application.

FIELD

The present embodiments generally relates to an edge stabilization assembly for inclined surfaces usable on golf courses.

BACKGROUND

A need exists for an edge stabilization assembly that provides water diversion and prevents trenching at the lowest most position of the inclined surface for golf courses.

A further need exists for preventing erosion and deterioration caused by flooding on shorelines and playgrounds.

The present embodiments meet these needs.

BRIEF DESCRIPTION OF THE DRAWINGS

The detailed description will be better understood in conjunction with the accompanying drawings as follows.

Figure 1:
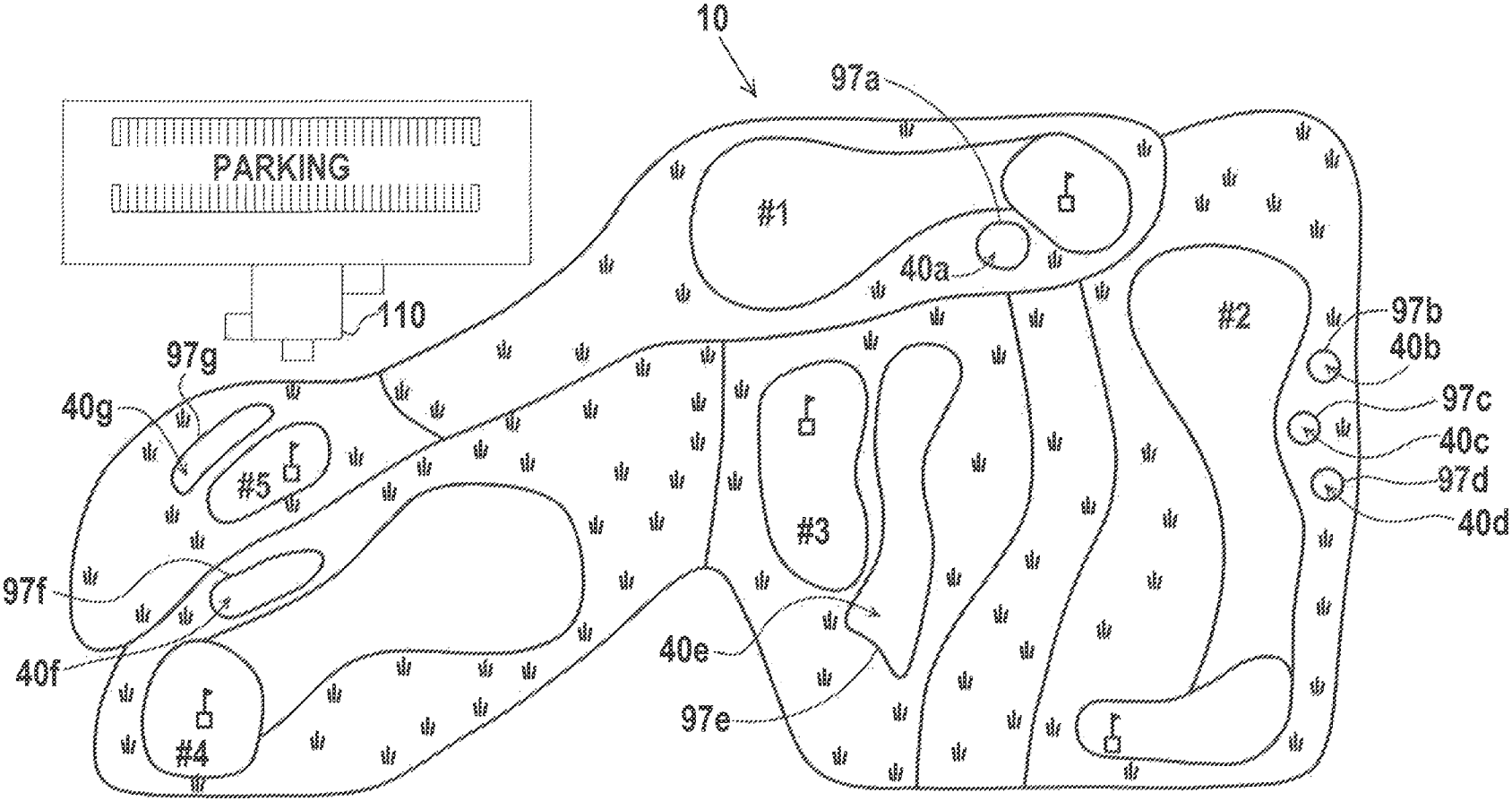
FIG. 1 depicts a golf facility with the edge stabilization assembly for inclined surfaces installed around individual sand bunkers.

The present embodiments are detailed below with reference to the listed Figures.

DETAILED DESCRIPTION OF THE EMBODIMENTS

Before explaining the present edge stabilization assembly in detail, it is to be understood that the edge stabilization assembly is not limited to the particular embodiments disclosed herein and that it can be practiced or carried out in various ways.

The edge stabilization assembly prevents erosion and deterioration caused by flooding, which is very helpful as instances like Hurricane Harvey which caused casualties.

The edge stabilization assembly is "environmentally friendly," keeping edges of inclined surfaces intact, so that people don't fall down due to deterioration of steps.

The edge stabilization assembly keeps the edges of lakes and waterways stable and prevents machines driving on the edges from falling into the water and causing destruction.

The edge stabilization assembly keeps pumps from flooding on irrigation projects, preventing the pumps from exploding or dumping contaminated water into the aquifer.

The edge stabilization assembly helps prevent water pollution by keeping the edge of a water area maintained and preventing debris from contaminating the water.

The invention is for an edge stabilization assembly for inclined surfaces having native soils, although not limited thereto.

The edge stabilization assembly includes, in a first embodiment, a synthetic tuft assembly.

The synthetic tuft assembly includes a synthetic tuft mat with a plurality of synthetic tufts woven through the synthetic tuft mat and extending solely from a top side of the synthetic tuft mat, with each synthetic tuft having a plurality of strands.

A non-permeable curable hot melt coating may be poured onto and exothermically cured onto the synthetic tuft mat on a side opposite the plurality of synthetic tufts forming a cured base on a side of the synthetic tuft mat opposite the plurality of synthetic tufts.

The synthetic tuft assembly includes a water-permeable polymer mesh connected on one side of the synthetic tuft mat. The water-permeable polymer mesh has a plurality of individual mesh openings configured to accept grass roots locking the water-permeable polymer mesh to at least one of: a lake edge, a golf course bunker, playground edge, or a landscaping edge.

The synthetic tuft assembly includes a tuft-free non-permeable woven polymer mat.

A first mold-resistant and water-resistant polymer thread is used to sew the water-permeable polymer mesh to the synthetic tuft mat with a first group of a plurality of stitches.

A second mold-resistant water-resistant polymer thread is used to sew the tuft-free non-water-permeable woven polymer mat to the synthetic tuft mat with a second group of a plurality of stitches.

The water-permeable polymer mesh is sewn in a spaced apart from the tuft-free non-water-permeable woven polymer mat and both are sewn to the top side of the synthetic tuft mat on the side with the plurality of synthetic tufts.

A plurality of fasteners are used as part of the edge stabilization assembly.

The water-permeable polymer mesh is anchored with a first group of the plurality of fasteners to a first side of an inclined surface of native soil enabling the synthetic tuft mat to cover a second side of the inclined surface of native soil without fasteners. Simultaneously, the tuft-free non-water-permeable woven polymer mat covers a third side of an inclined surface of native soil 201 with a second group of the plurality of fasteners.

The tuft-free non-water-permeable woven polymer mat provides water diversion and prevents trenching at the third side of the inclined surface, and wherein plant material is disposed over the water-permeable polymer mesh.

The formed edge stabilization assembly is capable of withstanding a category 1 Hurricane without detaching from the inclined surfaces.

The following definitions are used herein:

The term "anchored" refers to a removable water-permeable polymer mesh attached to the ground under the turf to withstand up to 25 gallons of water per minute flowing over the water-permeable polymer mesh without detaching from the ground under the turf "Anchored" also refers to the water-permeable polymer mesh attached to the ground under the turf to withstand at least a category 1 Hurricane wind without detaching.

The term "inclined surface" refers to a surface of native soil having three sides, a first side, a second side and a third side, wherein the first and second sides have an angle of inclination from 0 degrees to 45 degrees from the third side of native soil. A third side can be a bunker floor of a golf course sand bunker.

The term "native soil" refers to combinations of any of: dirt, grass, sand, clay, topsoil, mulch, gravel, and other porous organic materials that support grasses, and similar growing plants with stolons, such as golf course plants for greens and roughs, plants used as playground cushion.

The term "plant material" refers to grasses, or other growing plants, optionally with stolon, which may include less than 15% dirt, sand, clay, topsoil, mulch and gravel.

The invention relates to an edge stabilization assembly for inclined surfaces that have native soils, like dirt, grass turf.

The edge stabilization assembly includes a synthetic tuft assembly.

The synthetic turf assembly includes a synthetic tuft mat.

The synthetic tuft mat includes a plurality of synthetic tufts woven through the synthetic tuft mat and extending solely from a top side of the synthetic tuft mat.

Each of the plurality of synthetic tufts includes a plurality of strands.

The synthetic tuft mat includes a non-permeable curable hot melt coating cured onto the synthetic tuft mat forming a cured base on a side of the synthetic tuft mat opposite the plurality of synthetic tufts.

The edge stabilization assembly includes a water-permeable polymer mesh with a plurality of individual mesh openings sewn to the synthetic tuft mat. The water-permeable polymer mesh is configured to accept grass roots from the native soil, locking the water-permeable polymer mesh to at least one of: a lake edge, a golf course bunker, playground edge, landscaping edge.

The edge stabilization assembly includes a tuft-free non-water-permeable woven polymer mat sewn to the synthetic tuft map and the water-permeable polymer mesh but extending away from the synthetic tuft mat opposite the water-permeable polymer mesh.

A mold-resistant water-resistant polymer thread is used to sew the water-permeable polymer mesh and the tuft-free non-permeable woven polymer mat simultaneously to the synthetic tuft mat with a plurality of locking stitches.

A plurality of fasteners are used in the edge stabilization assembly.

In this embodiment, the water-permeable polymer mesh is anchored with a first group of the plurality of fasteners to a first side of an inclined surface of native soil enabling the synthetic tuft assembly to cover a second side of the inclined surface of native soil without fasteners, while enabling the tuft-free non-water-permeable woven polymer mat to cover a third side of the native soil using a second group of the plurality of fasteners.

The tuft-free non-water-permeable woven polymer mat provides water diversion and prevents trenching at the third side of the inclined surface, and wherein plant material is disposed over the water-permeable polymer mesh forming a hurricane 1 resistant edge stabilization assembly that prevents damaging erosion.

Each of the plurality of synthetic tufts have multiple strands. The plurality of synthetic tufts protrude from the cured base.

The plurality of synthetic tufts have multiple strands protruding from the non-permeable cured base at a height from ½ inch to 1 inch.

The synthetic tufts can be spaced from each other from 5/16 of an inch to 3/8 of an inch and the cured base.

Each strand of each tuft can be made from a flexible, bendable, non-deforming, non-breaking material at temperatures from 6 degrees Fahrenheit to 125 degrees Fahrenheit.

An embodiment, the synthetic tufts can have different height strands.

The plurality of synthetic tufts can be spaced apart from each other a distance from 5/16 of an inch to 3/8 of an inch, such as a uniform spacing apart of 7/32 of an inch.

Each of the plurality of strands can be made from one or more of the following polymers: a polyethylene, a polypropylene, and a polyurethane.

Each synthetic tuft can have from 8 strands to 20 strands.

The plurality of strands of each synthetic tuft can have a density of from 6600 to 8800 using a D-Tex™ density meter.

In other embodiments, some tufts can be made from material different from other tufts in the same assembly. Some tufts might simulate a short turf, other tufts might be sturdier and have a different stiffness, a different durometer, and a different impact strength.

For example, a cold climate golf course might need a different strand mix than a shoreline in South America with a completely different climate and different impact on the strands by water, waves, and wind.

The synthetic tuft mat with plurality of synthetic tufts and cured base can be formed from the non-permeable curable hot melt coating is from 5/8 inches to 1 inch in thickness.

The formed cured base creates a flexible, bendable, non-deforming, non-breaking material at temperatures from 6 degrees Fahrenheit to 125 degrees Fahrenheit.

The non-permeable curable hot melt coating can be a urethane polymer selected from the group consisting of homopolymer of urethane, copolymers of urethane, terpolymers of urethane including additional additives forming a from 1/32 of an inch to 1/8 inch thick coating on the synthetic tuft mat.

In embodiments, the edge stabilization assembly's water-permeable polymer mesh is a non-woven polyvinyl chloride mesh formed to prevent particles with a diameter greater than 1.5 millimeters from passing through the water-permeable polymer mesh.

The water-permeable polymer mesh can be a non-woven polyvinyl chloride mesh formed with individual mesh openings 177 of from 1/16 inch to 1/8 inch.

The water-permeable polymer mesh can have a density of woven fibers per inch of 10 per inch, and can have a weight of 370 grams per square foot.

In embodiments, the water-permeable polymer mesh includes from 8 to 13 woven fibers per inch.

In other embodiments, the water-permeable polymer mesh permits a flow rate from 5 gallons per minute to 25 gallons per minute while preventing particulates having a diameter of at least 1/32 inch from flowing through the water-permeable polymer mesh.

The size of the water-permeable polymer mesh can be 8 inches to 24 inches wide, and have a weight of 300 to 400 grams per square foot.

In embodiments of the edge stabilization assembly, the water-permeable polymer mesh permits easy penetration of turf grass roots providing additional anchoring of the mesh to the native soil by the grass roots through openings in the water-permeable polymer mesh.

In embodiments of the edge stabilization assembly, the size of the tuft-free non-permeable woven polymer mat can be 4 inches to 16 inches wide up to 36 inches, having a weight of 200 to 400 grams per square foot and a variable length depending on the need of the application.

The tuft-free non-permeable woven polymer mat can be made from a polymer selected from the group: polypropylene, polyethylene, and polyurethane.

In embodiments, the edge stabilization assembly includes a synthetic tuft assembly that is 4 inches to 36 inches wide and a variable length depending on the need of the application.

In embodiments, the edge stabilization assembly includes mold-resistant water-resistant polymer thread configured to form stitches holding components of the assembly together at a density of from 1 to 6 stitches per inch.

In embodiments, the edge stabilization assembly the plurality of stitches 175*a*-175*g* formed with the polymer thread through the water-permeable polymer mesh 104 to the synthetic tuft mat can be confirmed to be at least one of: a straight lock stitch, a zig-zag lock stitch, and a butt seam stitch.

In embodiments, the mold-resistant water-resistant polymer thread is from T-250 13-ounce 4 cord bonded polyester turf thread, a T-450 16-ounce 6 cord bonded polyester turf thread, to a T-600 8 cord 1 millimeter diameter thread.

In embodiments, the plurality of fasteners 144 are galvanized steel U-shaped fasteners for engaging turn, soil, sand through the water-permeable polymer mesh 104 and tuft-free non-permeable woven polymer mat 105.

Example Golf Course Usage

An edge stabilization assembly for an inclined surface of a sand bunker edge at a golf course may be 150 feet of a synthetic tuft mat having a plurality of synthetic tufts woven through the mat.

The plurality of synthetic tuft strands having a density of 18,900 strands per square meter with a height of 16 mm connected to a woven synthetic tuft mat may be used. The synthetic tuft mat is a flexible, bendable, but non-deforming, non-breaking material which remains intact at temperatures from 6 degrees Fahrenheit to 125 degrees Fahrenheit.

The synthetic tuft mat is made from a thin polypropylene mat having a thickness of 1.5 millimeter with regular openings.

A non-permeable curable hot melt coating is applied on synthetic tuft mat opposite the plurality of synthetic tufts forming a cured base.

The hot melt coating is disposed in a tray and then the synthetic tuft mat is moved through the hot melt coating, coating one side of the synthetic tuft mat forming the cured base. The coating, as it cures in this example, includes a thickness of 0.5 millimeters on the synthetic tuft mat.

A water-permeable polymer mesh is sewn through a portion of the plurality of synthetic tufts longitudinally engaging the cured base.

A 150 feet in length and 12 inch wide water-permeable polymer mesh made from polyvinyl chloride is used.

The water-permeable polymer mesh is a single layer flexible, bendable, mold-resistant material.

The water-permeable polymer mesh includes holes only large enough to accommodate grass root penetration from sod or turf grass to create an anchor between the turf grass and the native soil.

A tuft-free non-permeable woven polymer mat may be sewn through a portion of the plurality of synthetic tufts longitudinally engaging the cured base in parallel with the water-permeable polymer mesh.

A 150 feet long, 6 inch wide tuft free permeable woven polymer mat is used in this example.

A first mold-resistant and water-resistant polymer thread made from polyester having a diameter of 0.25 inches can be used to connect the water-permeable polymer mesh 104 to the cured base of the synthetic tuft mat.

The first mold-resistant and water-resistant polymer thread can be a three strand twisted polymer thread such as those made by NC Carpet, of Newark, N.J.

The first mold-resistant and water-resistant polymer thread may connect the water-permeable polymer mesh using a chain stitch of 5 stiches per inch stitched through a portion of the plurality of synthetic tufts to the cured base.

A second mold-resistant and water-resistant polymer thread connects the tuft-free, non-permeable woven polymer mat through a portion of the plurality of synthetic tufts to the cured base opposite the water-permeable polymer mesh.

Fasteners can be used, such as 4 fasteners per linear foot of material to attach the formed synthetic tuft assembly to native soil.

In this example, the fasteners affix the water-permeable polymer mesh and the tuft-free non-permeable woven polymer mat to native soil.

The fasteners in this example are galvanized steel 6 inch U-shaped staples that penetrate only the pores of the mesh and mat.

The water-permeable polymer mesh is anchored with 200 fasteners on one side of an inclined surface, which in this example, can be an inclined surface of a sand bunker at a golf course.

Without using fasteners, the synthetic tuft mat may cover the inclined surface of the sand bunker.

The non-permeable woven polymer mat may be fastened to an opposite side of the inclined surface of the sand bunker with another 200 fasteners.

The formed and mounted edge stabilization assembly may provide water diversion and prevent trenching at the lowest most position of the inclined surface of the sand bunker edge.

Example 2—Shoreline Use—Dirt and Sand Use

An edge stabilization assembly for inclined surfaces can be used to stabilize a shoreline at a golf course.

The overall size of the edge stabilization assembly is contemplated to have a 16 inch wide synthetic tuft mat over the inclined surface.

A synthetic tuft assembly can be placed over native soil between the water's edge and a green.

The water-permeable polymer mesh is fastened to the native soil with 3 U-shaped fasteners per foot that penetrate through the polymer mesh.

The synthetic tuft mat is fastened to native soil without any fasteners.

Sod is positioned over the water-permeable polymer mesh and watered.

The tuft-free, non-permeable woven polymer mat is fastened with 3 U-shaped fasteners per foot that penetrate through the tuft-free non-permeable woven polymer mat.

Example 3—Sand Based Playground Use

An edge stabilization assembly for inclined surfaces can be used for playgrounds having sand surfaces at a park.

The synthetic tuft mat can be positioned around the perimeter of a playground.

A water-permeable polymer mesh will be positioned over native soil and fastened with 2 U-shaped fasteners per foot. Sod is positioned over the water-permeable polymer mesh and watered.

A tuft-free, non-permeable woven polymer mat is installed on the subgrade of the playground and fastened with 2 U-shaped fasteners per foot, and then covered with the sand of the playground.

Example 4—Single Thread Version

This example is for an edge stabilization assembly for inclined surfaces with native soils, includes a synthetic tuft assembly that is 200 feet by 20 inches for a playground landscape next to a lake.

The edge stabilization assembly includes a synthetic tuft mat made from polypropylene.

A plurality of synthetic tufts are woven through the synthetic tuft mat and extending solely from a top side of the synthetic tuft mat to a height of ⅝ inch. 7 synthetic tufts per inch are used. Each of the plurality of synthetic tufts has 12 of strands of polypropylene fibers.

A non-permeable curable hot melt black coating is poured onto the synthetic tuft mat and allowed to self-cure in an exothermic reaction forming a cured base on a side of the synthetic tuft mat opposite the plurality of synthetic tufts.

A water-permeable polymer mesh with a plurality of individual mesh openings is configured to accept grass roots by locking the water-permeable polymer mesh to the playground on one side. The water-permeable polymer mesh has a density of mesh opening of 10.5 opening per inch.

A tuft-free non-water-permeable woven polymer mat is used, that is black.

A T-450 4 cord mold-resistant water-resistant polymer thread is used to sew the water-permeable polymer mesh, the tuft-free non-permeable woven polymer mat and the synthetic tuft mat together using with a plurality of straight lock stitches.

A plurality of fasteners, 1 per linear foot are used on the first and third sides of an inclined surface. Namely, the water-permeable polymer mesh is anchored with the plurality of fasteners to first side, the playground side of an inclined surface of native soil enabling the synthetic tuft assembly to cover a second side of the inclined surface without fasteners, and a third side adjacent the lake, having native soil with fasteners.

The tuft-free non-water-permeable woven polymer mat provides water diversion and prevents trenching at the third side of the inclined surface, and plant material such as turf is disposed over the water-permeable polymer mesh.

Turning now to the Figures.

FIG. 1 is a golf course facility 10 with a clubhouse 110 and with a plurality of golf holes, with each golf hole numbered separately as #1 golf hole, #2 golf hole, #3 golf hole, #4 golf hole, and #5 golf hole.

Adjacent each golf hole is at least one sand bunker. Sand bunker 40*a* is adjacent #1 golf hole. Sand bunkers 40*b*, 40*c*, and 40*d* are adjacent #2 golf hole. Sand bunker 40*e* is adjacent #3 golf hole. Sand bunker 40*f* is adjacent #4 golf hole. Sand bunker 40*g* is adjacent #5 golf hole.

Surrounding each sand bunker is one of the edge stabilization assemblies. Edge stabilization assembly 97*a* is depicted surrounding sand bunker 40*a*. Some sand bunkers are completely surrounded by an integral unit with overlapping edges. Some sand bunkers have segmented edge stabilization assemblies, such as 3 to 8 edge stabilization assemblies surrounding a single sand bunker.

The edge stabilization assembly 97*b* surrounds sand bunker 40*b*.

Edge stabilization assemblies 97*c* and 97*d* surround sand bunkers 40*c* and 40*d* respectively.

Sand bunker 40*e* has edge stabilization assembly 97*e*.

Sand bunker 40*f* has edge stabilization assembly 97*f*.

Sand bunker 40*g* has edge stabilization assembly 97*g*.

Figure 2:
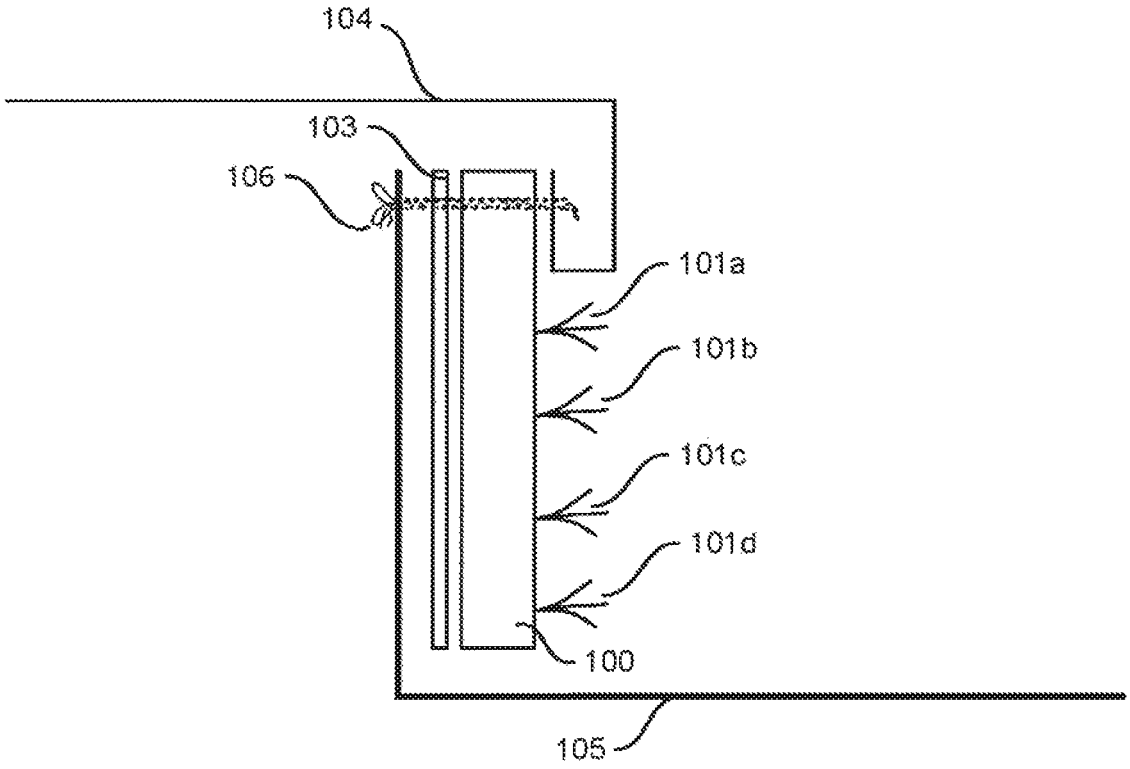
FIG. 2 shows an assembled version of the synthetic tuft assembly.

FIG. 2 depicts a side view of an embodiment of an assembled edge stabilization assembly 97 for inclined surfaces that may comprise native soils, having a synthetic tuft mat 100; a plurality of synthetic tufts 101*a*-101*d* woven through the synthetic tuft mat and extending solely from a top side of the synthetic tuft mat, each of the plurality of synthetic tufts comprising a plurality of strands; and a non-permeable curable hot melt coating cured onto the synthetic tuft mat forming a cured base 103 on a side of the synthetic tuft mat opposite the plurality of synthetic tufts. In addition, the assembly includes a water-permeable polymer mesh 104 with a plurality of individual mesh openings configured to accept grass roots locking the water-permeable polymer mesh to, without limitation, at least one of: a lake edge, a golf course bunker, a playground edge, and a landscaping edge; a tuft-free non-water-permeable woven polymer mat 105; and a first mold-resistant water-resistant polymer thread 106A configured to sew the water-permeable polymer mesh 104 and the tuft-free non-permeable woven polymer mat 105 to the synthetic tuft mat 100 together.

Figure 6:
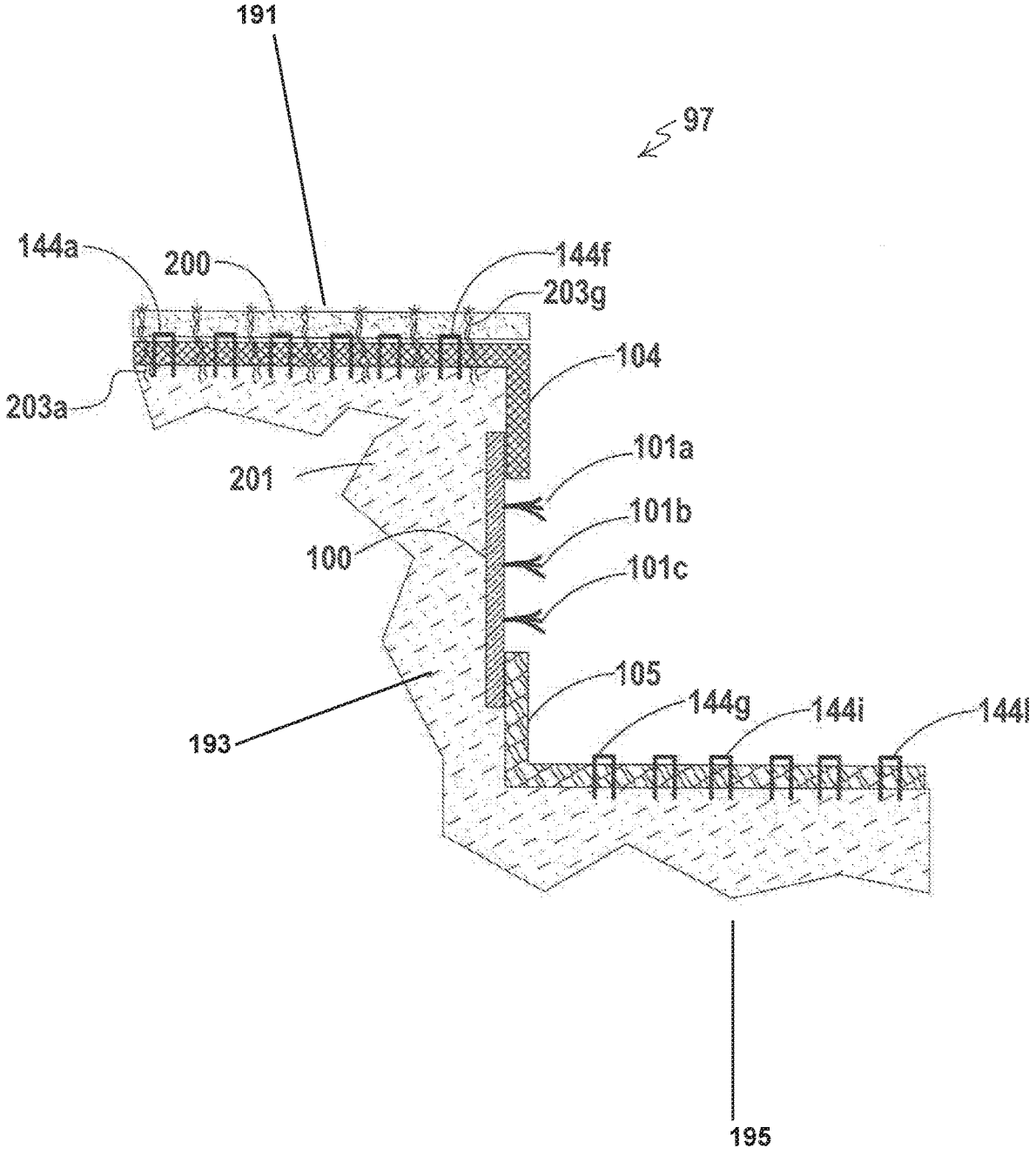
FIG. 6 depicts an edge stabilization assembly for inclined surfaces with fasteners connecting to native soil with grass penetrating the water-permeable polymer mesh.

Not shown in FIG. 2 are a plurality of fasteners used to anchor the water-permeable polymer mesh to a first side of an inclined surface of native or other soil permitting the synthetic tuft assembly to cover a second side of the inclined surface without fasteners, permitting the tuft-free non-water-permeable woven polymer mat to cover a third side of the native soil with a second group of the plurality of fasteners, (more detail is shown in FIG. 6) and wherein the tuft-free non-water-permeable woven polymer mat provides water diversion and prevents trenching at the third side of the inclined surface, and wherein plant material is disposed over the water-permeable polymer mesh.

Figure 3A:
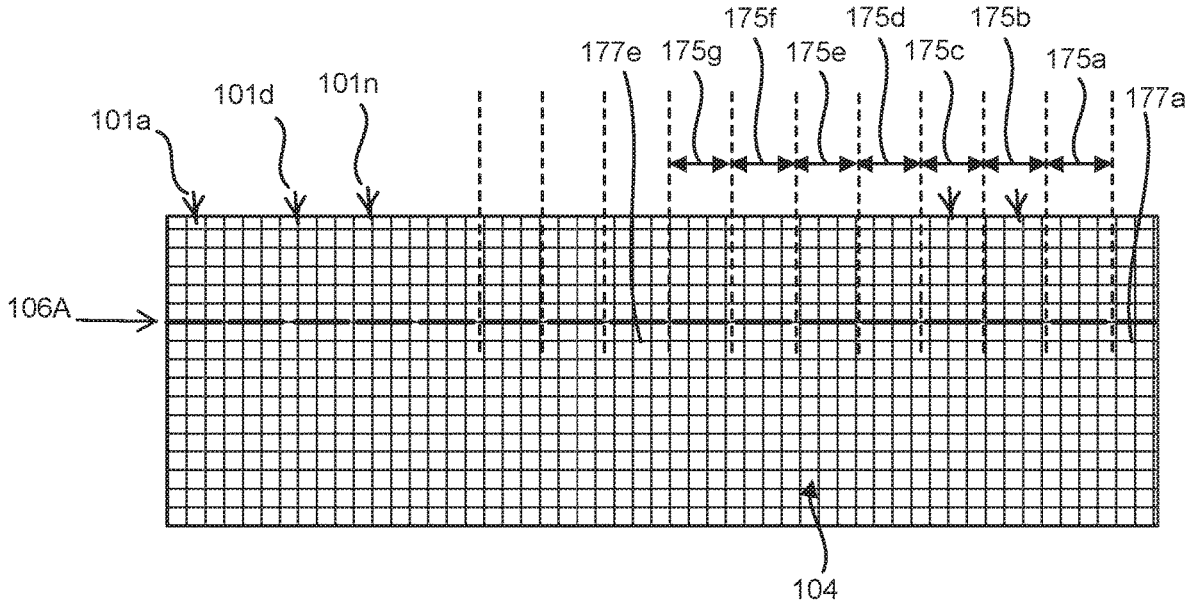
FIG. 3A is a detail of the stitches and the water-permeable polymer mesh according to an embodiment of the invention.

FIG. 3A depicts a top view of the synthetic tuft assembly showing tufts 101*a*-101*k* and water-permeable polymer mesh 104 sewn with the thread to the synthetic tuft mat with a plurality of stitches 175*a-g*

Figure 3B:
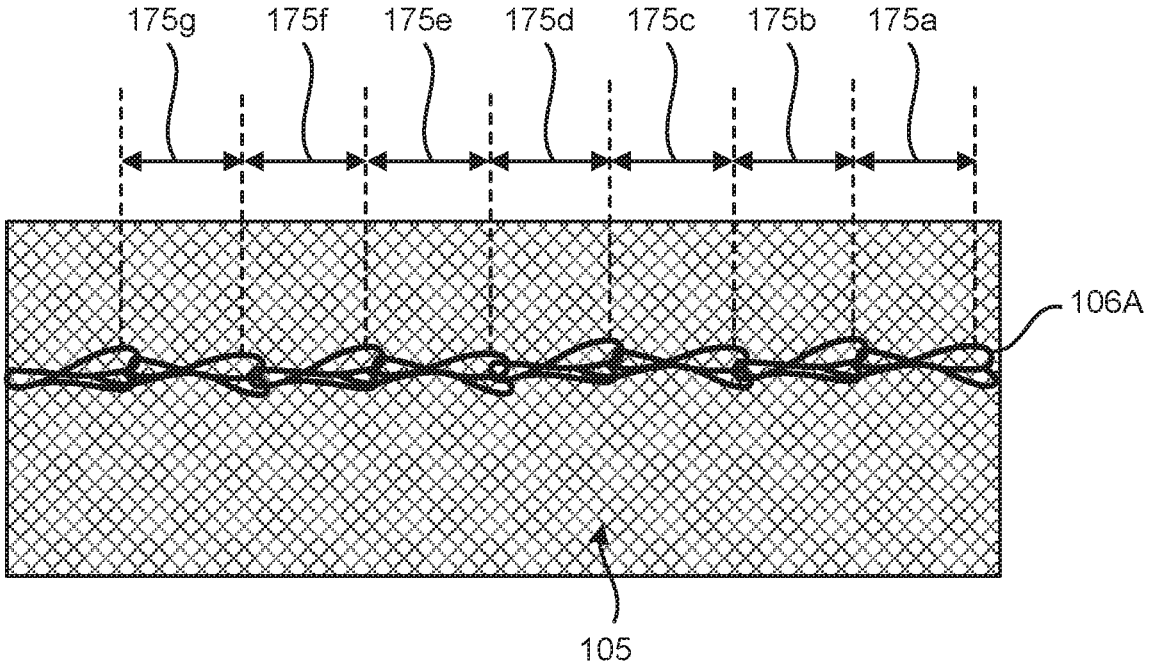
FIG. 3B is a detail of the stitches from the reverse side of the assembly of FIG. 3A, depicting a tuft-free non-permeable woven polymer mat

FIG. 3B depicts a back view of the synthetic tuft assembly 99 with the tuft-free non-permeable woven polymer mat 105 attached to the cured base of the synthetic tuft mat with a plurality of stitches 175*a-g*. Thread 106A is depicted as it is formed into stitches.

Figure 4A:
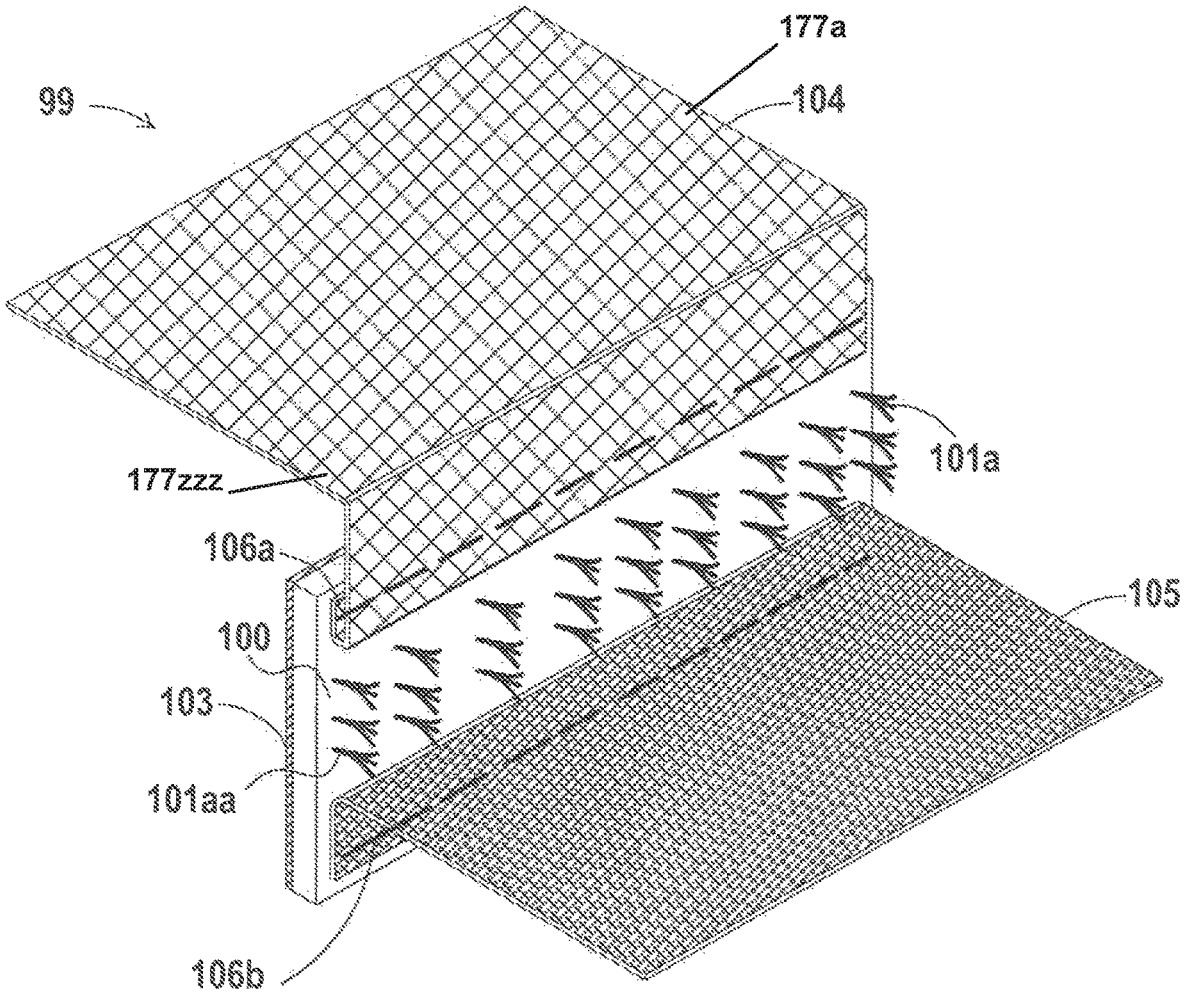
FIG. 4A shows an assembled version of the synthetic tuft assembly according to another embodiment of the invention.
Figure 4B:
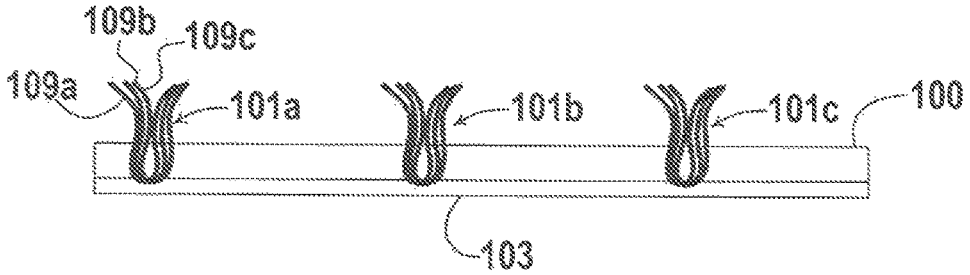
FIG. 4B shows a detail of the tufts and side view of an embodiment of the synthetic tuft assembly.

FIG. 4A and FIG. 4B depict a synthetic tuft assembly 99 of another assembled version of the edge stabilization assembly for mounting on an inclined edge of native or other soils, such as at 90 degrees, specifically, for a shoreline. The definitions define the range of angles of inclination of the inclined edge.

The synthetic tuft assembly 99 has a synthetic tuft mat 100.

Woven to the synthetic tuft mat 100 are a plurality of synthetic tufts 101*a*-101*aa* woven through the synthetic tuft mat 100 and extending solely from a top side of the synthetic tuft mat 100.

Each synthetic tuft, such as 101*a*, has a plurality of strands 109*a*, 109*b*, and 109*c* shown in FIG. 4B for synthetic tuft 101*a*. Although three stands 109*a*-109*c* are shown, other embodiments may use other numbers of strands. The strands are woven into the synthetic tuft mat rather than glued to the top of the mat. The plurality of synthetic tufts 101*a*-101*aa* are woven through the synthetic tuft mat and extend solely from a top side of the synthetic tuft mat.

As shown in FIG. 4B, a plurality of synthetic tufts are depicted as 101*a*, 101*b*, and 101*c*. Additionally, in FIG. 4B, a non-permeable curable hot melt coating that has cured onto one side of the synthetic tuft mat forms a cured base 103 on a side of the synthetic tuft mat 100 opposite the plurality of synthetic tufts Returning to FIG. 4A, opposite the plurality of synthetic tufts is cured base 103 formed from a non-permeable curable hot melt coating that has cured typically with an exothermic reaction. The cured base 103 is formed by flowing and curing the non-permeable curable hot melt coating about 1/10 inch thick onto a side of the synthetic tuft mat opposite the plurality of synthetic tufts 101*a-aa.*

A water-permeable polymer mesh 104 is folded on one edge and the folded edge is mounted to a top side of the synthetic tuft mat 100 along one edge of the synthetic tuft mat 100.

The water-permeable polymer mesh 104 has a plurality of individual mesh openings shown as elements 177*a*-177*zzz* in other figures, configured to accept grass roots locking the water-permeable polymer mesh to, without limitation, at least one of: a lake edge, a golf course bunker, playground edge, landscaping edge.

The water-permeable polymer mesh 104 is folded at a point of contact with the synthetic tuft mat 100. This fold imparts strength and resistance to tearing to the edge stabilization assembly.

A first mold-resistant and water-resistant polymer thread 106*a* is used to sew the folded two layers of water-permeable polymer mesh 104 to the top side of the synthetic tuft mat along only one side of the synthetic tuft mat.

The first mold-resistant and water-resistant polymer thread 106*a* connects the folded, now two layer, water-permeable polymer mesh 104 by a plurality of locking stiches sewn through a portion of the plurality of synthetic tufts to the cured base 103 of the synthetic tuft mat 100. FIGS. 3A and 3B show the stitches being formed through the synthetic tuft mat from the top side through the cured base on the bottom side and back again.

The first mold-resistant and water-resistant polymer thread 106A is configured to sew the water-permeable polymer mesh 104 to the synthetic tuft mat 100 with a plurality of stitches 175*a*-175*q* (shown as locking stitches in FIGS. 3A and 3B).

A second mold-resistant and water-resistant polymer thread 106*b* connects an unfolded the tuft-free non-permeable woven polymer mat 105 through a portion of the plurality of synthetic tufts to the cured base 103 as shown in FIGS. 3A and 3B.

The unfolded tuft-free non-water-permeable woven polymer mat 105 is joined to the synthetic tuft mat spaced apart from the water-permeable polymer mesh 104 but on the same top side as the water-permeable polymer mesh 104.

FIG. 4A shows additional synthetic tufts 101*a*-101*aa* extending through the synthetic polymer mat.

Each synthetic tuft is contemplated, in an embodiment, as having a plurality of strands. In an embodiment, the plurality of strands can have different stiffness one to another or groups of tufts can have different stiffness from other groups of tufts.

Although not shown in FIG. 4A, a first group of a plurality of individual fasteners are used to anchor the water-permeable polymer mesh to a first side of an inclined surface of native soil enabling the synthetic tuft assembly to cover a second side of the inclined surface without fasteners. Then a third side of edge stabilization assembly, the 105 is fastened to the native soil with another group of individual fasteners, and wherein a tuft-free non-water-permeable woven polymer mat provides water diversion and prevents trenching at the third side of the inclined surface, and wherein plant material is disposed over the water-permeable polymer mesh. FIG. 6 depicts these sides as elements 191, 193 and 195.

Figure 5:
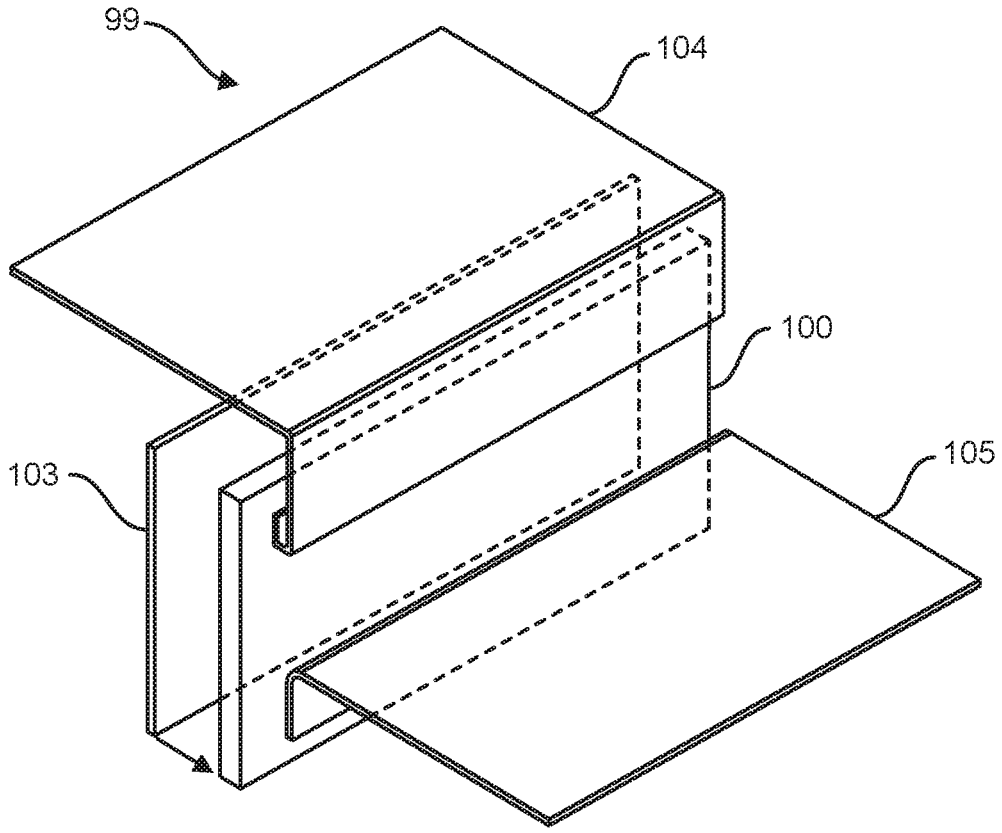
FIG. 5 depicts a partially exploded view of one of the embodiments of the edge stabilization assembly for inclined surfaces.

FIG. 5 shows a partially exploded view of the components of the synthetic tuft assembly 99 with a synthetic tuft mat 100 exploded away from the cured base 103.

Also shown in FIG. 5 is a water-permeable polymer mesh 104; a tuft-free non-permeable woven polymer mat 105.

FIG. 6 depicts an edge stabilization assembly 97 for an L-shaped inclined surfaces of native or other soil 201 such as an edge of a lake.

The edge stabilization assembly 97 is depicted connected with fasteners 144*a*-1441 to native or other soil 201 having grass roots 203*a*-203*g* depicted penetrating the water-permeable polymer mesh 104.

The fasteners 144*a*-1441 can be a plurality of shapes, U-shaped, T-shaped, and other curvilinear shapes.

Sod 200 is positioned over the water-permeable polymer mesh 104 of the edge stabilization assembly 97 after the water-permeable polymer mesh 104 has been affixed to a first side 191 of native soil 201 with U-shaped fasteners 144*a*-144*f*.

The integrally connected synthetic tuft mat 100 is shown affixed to the water-permeable polymer mesh 104 and extending along a second side 193 of native soil without the need for fasteners. The synthetic tuft mat 100 is depicted with synthetic tufts 101*a*, 101*b*, and 101*c* protruding from the synthetic tuft mat 100 only along the top side of the synthetic tuft mat.

A tuft-free non-permeable woven polymer mat 105 is depicted as affixed to the synthetic tuft mat 100 on a side opposite the water-permeable polymer mesh 104.

The tuft-free non-water-permeable woven polymer mat 105 is shown secured to a bunker floor of native soil, which can be termed a third side 195 of the inclined surface of native soil 201 with a second group of the plurality of fasteners 144*g*-1441.

Portions of the tuft-free non-permeable woven polymer mat 105 and water-permeable polymer mesh 104 can be folded to protect the mold-resistant water-resistant polymer threads preventing the mold-resistant water-resistant polymer threads 106*a* and 106*b* from being exposed to particles, chemicals and water which are used to connect the tuft-free non water-permeable woven polymer mat 105 and the water-permeable polymer mesh 104 to the synthetic tuft mat 100 which are not shown in FIG. 6.

While these embodiments have been described with emphasis on the embodiments, it should be understood that within the scope of the appended claims, the embodiments might be practiced other than as specifically described herein.

What is claimed is:

1. An edge stabilization assembly for inclined surfaces comprising native soils, comprising:

a. a synthetic tuft assembly comprising:

i. a synthetic tuft mat;

ii. a plurality of synthetic tufts woven through the synthetic tuft mat and extending solely from a top side of the synthetic tuft mat, each of the plurality of synthetic tufts comprising a plurality of strands; and iii. a non-permeable, curable, hot melt coating cured onto the synthetic tuft mat forming a cured base on a side of the synthetic tuft mat opposite the plurality of synthetic tufts;

iv. a water-permeable polymer mesh with a plurality of individual mesh openings configured to accept grass roots locking the water-permeable polymer mesh;

v. a tuft-free non-water-permeable woven polymer mat;

vi. a first mold-resistant water-resistant polymer thread configured to sew the water-permeable polymer mesh and the tuft-free non-permeable woven polymer mat to the synthetic tuft mat with a plurality of stitches; and b. a plurality of fasteners;

and wherein the tuft-free non-water-permeable woven polymer mat provides water diversion and prevents trenching at a third side of the inclined surface, and wherein plant material is disposed over the water-permeable polymer mesh.

2. The edge stabilization assembly of claim 1, wherein the plurality of strands of each synthetic tuft has a density of from 6600 to 8800 as measured using a density meter.

3. The edge stabilization assembly of claim 1, wherein the plurality of synthetic tufts protrude from the cured base, wherein the plurality of synthetic tufts have multiple strands protruding from the non-permeable cured base at a height from ½ inch to 1 inch and wherein the synthetic tufts are spaced from each other from 5/16 of an inch to ⅜ of an inch and the cured base comprises a flexible, bendable, non-deforming, non-breaking material at temperatures from 6 degrees Fahrenheit to 125 degrees Fahrenheit.

4. The edge stabilization assembly of claim 1, wherein each of the plurality of strands comprises at least one of: a polyethylene, a polypropylene, and a polyurethane; and each tuft comprises from 8 strands to 20 strands.

5. The edge stabilization assembly of claim 1, wherein the water-permeable polymer mesh is a non-woven polyvinyl chloride mesh formed with individual mesh openings of from 1/16 inch to ⅛ inch.

6. The edge stabilization assembly of claim 1, wherein the water-permeable polymer mesh comprises from 8 to 13 woven fibers per inch.

7. The edge stabilization assembly of claim 1, wherein the water-permeable polymer mesh permits a flow rate from 5 gallons per minute to 25 gallons per minute while preventing particulates having a diameter of at least 1/32 inch from flowing through the water-permeable polymer mesh.

8. The edge stabilization assembly of claim 1, wherein the size of the water-permeable polymer mesh is 8 inches to 24 inches wide, having a weight of 300 to 400 grams per square foot.

9. The edge stabilization assembly of claim 1, wherein the size of the tuft-free non-permeable woven polymer mat is 4 inches to 16 inches wide, having a weight of 200 to 400 grams per square foot and comprising a polymer selected from the group: polypropylene, polyethylene, and polyurethane.

10. The edge stabilization assembly of claim 1, wherein the synthetic tuft assembly is 4 inches to 36 inches wide.

11. The edge stabilization assembly of claim 1, wherein the mold-resistant water-resistant polymer thread comprises stitches at from 1 to 6 stitches per inch.

12. The edge stabilization assembly of claim 1, wherein the plurality of stitches of the water-permeable polymer mesh 104 to the synthetic tuft mat comprises at least one of: a straight lock stitch, a zig-zag lock stitch, and a butt seam stitch.

13. The edge stabilization assembly of claim 1, wherein the mold-resistant water-resistant polymer thread is from T-250 13-ounce 4 cord bonded polyester turf thread, a T-450 16-ounce 6 cord bonded polyester turf thread, to a T-600 8 cord 1 millimeter diameter thread.

14. The edge stabilization assembly of claim 1, wherein the non-permeable curable hot melt coating comprises a urethane polymer selected from the group consisting of homopolymer of urethane, copolymers of urethane, terpolymers of urethane including additional additives forming a from 1/32 of an inch to ⅛ inch thick coating on the synthetic tuft mat.

15. The edge stabilization assembly of claim 1, wherein the synthetic tuft mat with plurality of synthetic tufts and cured base formed from the non-permeable curable hot melt coating is from ⅝ inches to 1 inch in thickness.

16. The edge stabilization assembly of claim 1, wherein the plurality of fasteners are galvanized steel U-shaped fasteners for engaging turf, soil, and sand through the water-permeable polymer mesh and tuft-free non-permeable woven polymer mat.

17. An edge stabilization assembly for inclined surfaces comprising native soils, comprising:

a. a synthetic tuft assembly comprising:

i. a synthetic tuft mat;

ii. a plurality of synthetic tufts woven through the synthetic tuft mat and extending solely from a top side of the synthetic tuft mat, each of the plurality of synthetic tufts comprising a plurality of strands; and iii. a non-permeable curable hot melt coating cured onto the synthetic tuft mat forming a cured base on a side of the synthetic tuft mat opposite the plurality of synthetic tufts;

iv. a water-permeable polymer mesh with a plurality of individual mesh openings configured to accept grass roots locking the water-permeable polymer mesh to at least one of: a lake edge, a golf course bunker, playground edge, and a landscaping edge;

v. a tuft-free non-water-permeable woven polymer mat;

vi. a first mold-resistant water-resistant polymer thread configured to sew the water-permeable polymer mesh to the synthetic tuft mat with a first group of a plurality of stitches;

vii. a second mold-resistant water-resistant polymer thread configured to sew the tuft-free non-water-permeable woven polymer mat to the synthetic tuft mat with a second group of a plurality of stitches; wherein the water-permeable polymer mesh is spaced apart from the tuft-free non-water-permeable woven polymer mat;

b. a plurality of fasteners; and wherein the water-permeable polymer mesh is anchored with a first group of the plurality of fasteners to a first side of an inclined surface of native soil enabling the synthetic tuft mat to cover a second side of the inclined surface of native soil without fasteners, with the tuft-free non-water-permeable woven polymer mat covering a third side of inclined surface of native soil with a second group of the plurality of fasteners, and wherein the tuft-free non-water-permeable woven polymer mat provides water diversion and prevents trenching at the third side of the inclined surface, and wherein plant material is disposed over the water-permeable polymer mesh.

18. The edge stabilization assembly of claim 17, wherein the plurality of synthetic tufts protrude from the cured base, wherein the plurality of synthetic tufts have multiple strands protruding from the non-permeable cured base at a height from ½ inch to 1 inch and wherein the synthetic tufts are spaced from each other from 5/16 of an inch to ⅜ of an inch and the cured base comprises a flexible, bendable, non-deforming, non-breaking material at temperatures from 6 degrees Fahrenheit to 125 degrees Fahrenheit.

19. The edge stabilization assembly of claim 17, wherein the water-permeable polymer mesh is a non-woven polyvinyl chloride mesh formed with individual mesh openings of from 1/16 inch to ⅛ inch.

20. The edge stabilization assembly of claim 17, wherein the water-permeable polymer mesh comprises from 8 to 13 woven fibers per inch.

21. The edge stabilization assembly of claim 17, wherein the size of the tuft-free non-permeable woven polymer mat is 4 inches to 16 inches wide, having a weight of 200 to 400 grams per square foot and comprising a polymer selected from the group: polypropylene, polyethylene, and polyurethane.

22. The edge stabilization assembly of claim 17, wherein the mold-resistant water-resistant polymer thread comprises stitches at from 1 to 6 stitches per inch.

23. The edge stabilization assembly of claim 17, wherein the plurality of stitches of the water-permeable polymer mesh to the synthetic tuft mat comprises at least one of: a straight lock stitch, a zig-zag lock stitch, and a butt seam stitch.

* * * * *